United States Patent [19]

Tomalinas, Jr.

[11] 3,990,667

[45] Nov. 9, 1976

[54] SWING AND SUPPORT FRAME ASSEMBLY THEREFOR

[75] Inventor: William R. Tomalinas, Jr., Wapwallopen, Pa.

[73] Assignee: Roth American, Inc., Wilkes-Barre, Pa.

[22] Filed: May 5, 1975

[21] Appl. No.: 574,279

[52] U.S. Cl. ..... 248/370; 272/85

[51] Int. Cl.[2] ..... A45D 19/04

[58] Field of Search ..... 248/370, 163, 188, 5; 211/182; 272/24, 85, 86, 87, 88, 89, 90, 91, 92, 60 R, 60 A

[56] References Cited

UNITED STATES PATENTS

| | | | |
|---|---|---|---|
| 2,325,456 | 7/1943 | Williams | 272/85 |
| 2,699,201 | 1/1955 | Levy | 272/87 |
| 3,229,790 | 1/1966 | Shayne | 211/182 |
| 3,256,016 | 6/1966 | Berlin | 272/85 |

FOREIGN PATENTS OR APPLICATIONS

| | | | |
|---|---|---|---|
| 936,000 | 9/1963 | United Kingdom | 248/370 |

*Primary Examiner*—Robert A. Hafer

*Attorney, Agent, or Firm*—Burns, Doane, Swecker & Mathis

[57] ABSTRACT

A support frame for a swing having bouncing pendular motion includes a pair of mutually inclined U-shaped frames and a pair of support brackets. The brackets space the upper portions of the frames from one another, inhibit relative lateral movement between the frames, cooperate with aligned openings to position the frames in an inclined manner, support the swing directly, and distribute force loads of the swing to horizontally extending surfaces of the frames. In addition, the swing support frame is adapted for disassembly into 14 pieces sized to facilitate their commercial transportation by merely disassembling eight connecting assemblies.

1 Claim, 5 Drawing Figures

SWING AND SUPPORT FRAME ASSEMBLY THEREFOR

BACKGROUND OF THE INVENTION

The present invention relates generally to swings and support frame assemblies therefor. More specifically, the present invention relates to an easily assembled swing support frame having a unique support bracket.

In the past it has been known to support a child's swing assembly from a generally horizontal member supported at each end by a generally A-shaped frame assembly. Such frame assemblies, however, typically support the swing assembly from a pair of bolts extending through the horizontal member. Accordingly, the force loads generated by the swing are transmitted to the horizontal member over a small area under the nut holding the bolt in position. Thus the wall thickness of the horizontal member must be adequate to resist the concentrated force causing an unduly heavy structure. Moreover, the presence of a bolt receiving opening aggravates the undesirability of the known structures by causing classical stress concentrations which weaken the horizontal support member.

In addition, the known swing support assemblies comprise complicated assemblies which are difficult to assemble and disassemble due to the myriad members and connectors that are often used therewith. A particularly undesirable feature which is common during assembly is the lack of free-standing subassemblies which can facilitate positioning and alignment of other members attached thereto.

Those swing support assemblies which are collapsible frequently have foldable braces and slidably connected members. It can readily be seen that if a swing begins to tip a slidable or foldable member may accidentally become dislocated from a supporting posture and thereby ensure tipping of the swing either immediately or during a future pendular oscillation.

Thus, it will be observed that a need still exists for a swing support frame assembly adaptable for use as a support for children's swings during pendular oscillation while providing a lightweight easily assembled structure that distributes swing supporting forces.

OBJECTS AND SUMMARY OF THE PREFERRED EMBODIMENT OF THE INVENTION

It is a general object of the present invention to overcome the above and other problems associated with known devices.

It is a more specific object of the present invention to provide a novel swing support frame assembly having swing support brackets which distribute forces to leg members while spacing the upper ends of leg members and inhibiting movement therebetween.

Another object of the present invention is to provide a novel swing support frame assembly which is fabricated from lightweight tubular materials.

A further object of the present invention is to provide a novel swing support frame assembly which is readily disassembled for transportation in a container that may be accommodated by most conventional carrying methods.

It is yet another object of the present invention to provide a novel swing support frame assembly having a minimum number of parts which are easily connected together by suitable fastening members.

A preferred embodiment of a swing support frame assembly intended to accomplish these and other objects includes four tubular leg members each having a curved leg portion which defines a lateral angle between the corresponding leg and a supporting surface and each having a short tubular end portion extending laterally from the curved leg portion. The short tubular end portion of each leg includes a bolt receiving opening with an axis inclined to the plane of the curved leg portion to define a longitudinal angle between the corresponding leg and the supporting surface. By selecting the curvature of the curved leg portion and the inclination of the bolt axis, such that the corresponding lateral and longitudinal angles are obtuse, an increased stability results for the swing frame since longitudinal or lateral movement of the short tubular end portion must include an increase in the vertical elevation thereof.

The support frame assembly also includes a pair of tubular support bars. Each bar has two ends that have bolt receiving openings therein. Each bar end is telescopically received in a corresponding short tubular end portion such that the bolt receiving openings of the end and the corresponding end portion are aligned. The telescopic connection augments the ability of the bar and legs to transmit force moments therebetween. Each bar and the associated pair of legs defines a generally U-shaped support frame.

The swing support frame assembly is also provided with a pair of spaced apart bracket members each of which engages both U-shaped support frames to space the upper end portions thereof in a parallel relationship with the legs in mutually inclined relation to one another. Each bracket includes two generally cylindrically configured ends that conform to the external surface of the corresponding leg. With the bracket members rigidly connected to the U-shaped frames, the cylindrically configured ends cooperate to distribute force loadings to each of the two bars while distributing the forces over a substantial surface area thereof to minimize the classical stress concentration effect and permit thinner walled materials to be used. Moreover, the bracket members cooperate with the two bars to resist lateral displacement of the two bars.

Each tubular leg member may be comprised of an upper leg member telescopically joined to a lower leg member. The upper leg member includes the curved portion, the short tubular end portion and a lower portion having a bolt receiving opening. The lower leg member also includes a bolt receiving opening. A pair of longitudinal braces may be provided having two ends with bolt receiving openings. One end of each longitudinal brace may be connected to the telescopically joined upper and lower leg member with the bolt receiving openings of each being aligned. In the foregoing manner, the legs may be disassembled into shorter elements whereas the braces assist retention of the inclined relationship between the two U-shaped frames.

The upper and lower leg members may be of substantially equal length to economize the size and cost of a container required for shipping in disassembled form. Moreover, the connection between either a leg, a bar and a bracket or an upper leg member, a lower leg member and a brace may be effected by a single threaded connector. Accordingly, the number of required connections for the fourteen component members has been reduced to eight thereby facilitating ease of assembly and disassembly.

BRIEF DESCRIPTION OF THE DRAWINGS

The above and many other objects of the present invention will be apparent to those skilled in the art when this specification is read in conjunction with the appended drawings wherein like reference numerals have been applied to like elements and wherein.

DETAILED DESCRIPTION OF THE PREFERRED EMBODIMENT

Figure 1:
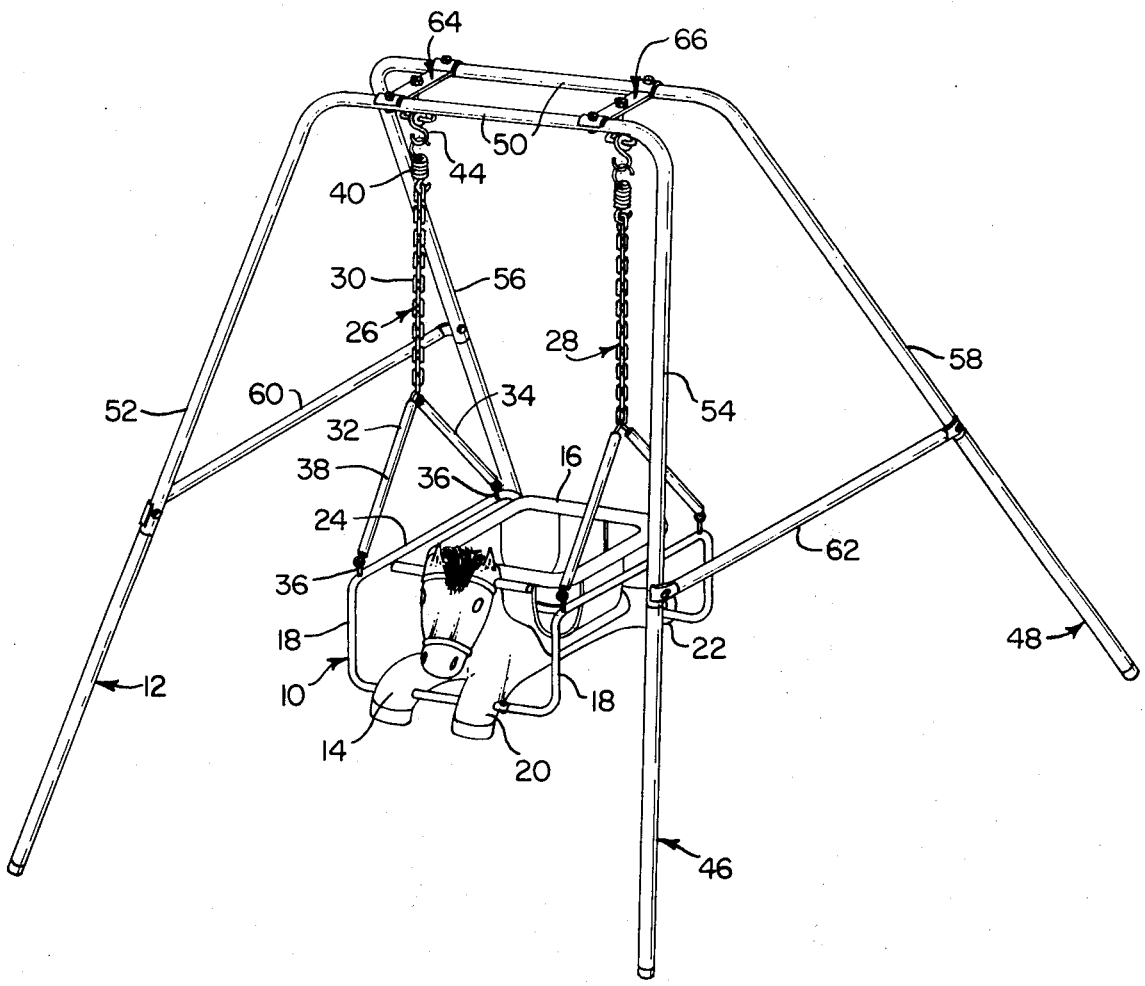
FIG. 1 is a perspective view of a swing supported by a swing frame support assembly according to a preferred embodiment of the present invention.

Depicted in FIG 1 is a child's swing including a swing assembly 10 mounted for longitudinal swinging movement relative to a swing support frame assembly 12. The swing assembly 10 may include an animal facsimile object 14, such as the horse as illustrated, provided with a detachable polyethylene seat 16. The polyethylene seat permits the use of the swing by infants who might otherwise fall off a pendularly swinging object without external support.

The animal facsimile object 14 may be provided with a frame 18 on each side thereof adapted for connection to forward and rearward portions 20, 22 respectively of the animal facsimile object 14. In addition, each frame 18 extends vertically upwardly and horizontally from the animal facsimile object 14 to provide a handrail portion 24 that may be grasped by an infant, or by a larger child riding the swing assembly 10 with the seat 16 detached therefrom.

The swing assembly 10 is supported by identical chain assemblies 26, 28 connected to each handrail portion 24. By virtue of their identity, only one chain assembly need be described for a complete understanding of both assemblies. Accordingly, the chain assembly 26 includes an upper chain portion 30 from which a pair of suitably attached lower chain portions 32, 34 depend downwardly. Each of the lower chain portions 32, 34 is connected to a corresponding eye bolt 36 connected to and extending through the handrail portion 24 of the frame 18. Each lower chain 32, 34 may be provided with a suitable tubular plastic or rubber cover 38 which substantially encloses the links of the associated lower chain to prevent pinching of a child's fingers while riding the swing assembly 10.

The upper end portion of each chain assembly 26 is attached to the lower end of an extensible spring 40. The upper end of the extensible spring 40 is hooked onto a swing bearing assembly 44 which permits pendular motion of the swing assembly 10 and supporting chain assemblies 26, 28 with respect to the spring support frame 12. The extensible spring 40 permits a bouncing movement to be impressed upon the pendular movement of the swing assembly 10 and thereby provide a complex oscillatory movement of the swing 10. Moreover, the pair of lower chain portions 32, 34 cooperate with upper chain portion 30 to introduce yet another degree of freedom into the complex oscillatory movement of the swing 10.

Turning now to the swing support frame assembly 12, a pair of generally U-shaped frames 46, 48 are provided which are mutually inclined toward one another such that the upper portions are substantially closer together than the lower portions thereof which engage a supporting surface. In this manner, the lower portions of the spring support frame 12 are spaced apart laterally and longitudinally to provide a very stable platform within which the swing assembly 10 is free to pendularly oscillate.

Each U-shaped frame assembly 46, 48 includes an upper generally horizontal tubular bar member 50 and a pair of ground engaging members or legs 52, 54. The legs 52, 54 of the front frame 46 are securely spaced in position with respect to the legs 56, 58 of the rear U-shaped frame 48 by means of longitudinally extending reinforcing brace members 60, 62. Each reinforcing brace member 60, 62 is securely attached to one leg of both U-shaped frames 46, 48 such that the frames 46, 48 are held in their mutually inclined position as illustrated in FIG. 1.

The upper portion of each U-shaped frame 46, 48 is spaced apart from the other frame by a pair of spacing brackets 64, 66. Each spacing bracket 64, 66 engages one leg of each U-shaped frame assembly 46, 48 and spaces the generally horizontal support portions 50 apart from one another. The brackets 64, 66 are laterally positioned with respect to the corresponding frame assemblies 46, 48 such that they are in general alignment with the chain assemblies 26, 28 supporting the swing apparatus 10.

Figure 2:
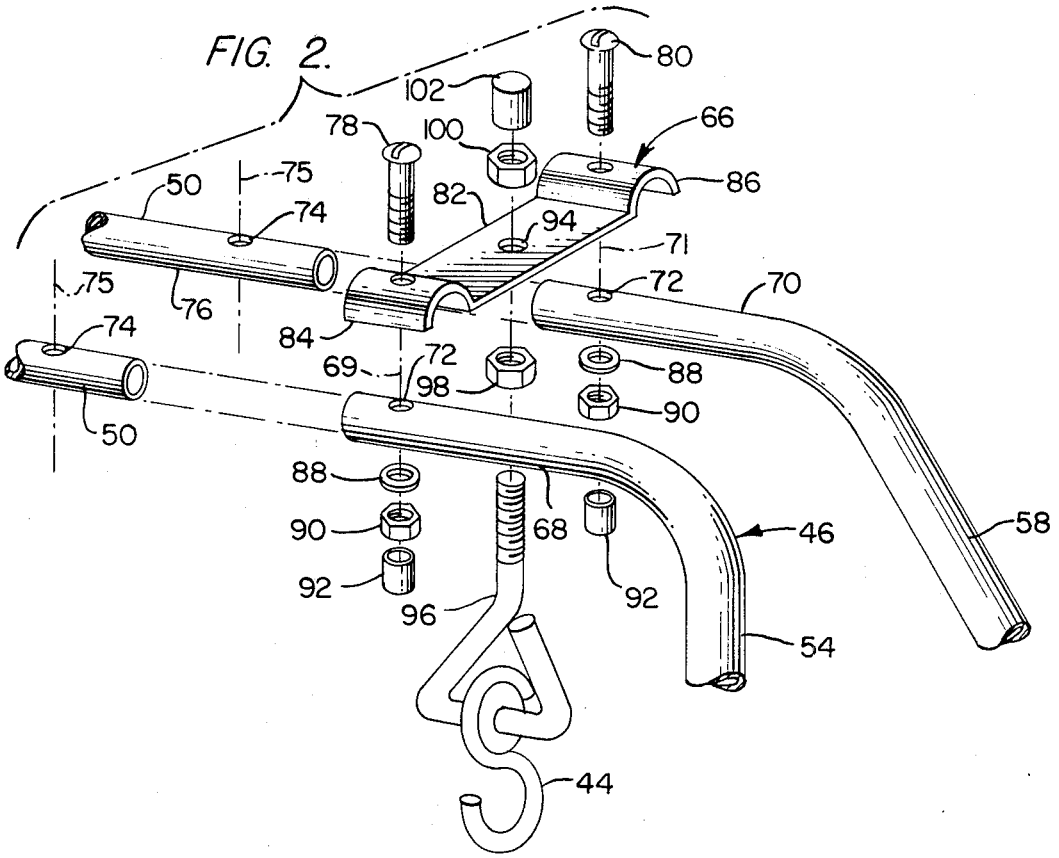
FIG. 2 is an enlarged partial view in perspective of the spacing bracket of the swing support frame assembly in partially exploded position to illustrate the manner whereby assembly is accomplished.

Turning now to FIG. 2, the upper portion of each leg 54, 58 is provided with a short tubular end portion 68, 70 angularly disposed with respect thereto to facilitate a telescopic connection between each leg 54, 58 and the corresponding bar member 50. Each end portion 68, 70 is provided with a suitable bolt receiving opening 72 adjacent the end thereof and having an axis 69, 71 respectively. Both ends of each bar member 50 are provided with a bolt opening 74 which is designed to align with the bolt opening 72 when the top bar 50 is telescopically assembled with respect to the corresponding leg 54. Each bolt opening 74 has an axis 75 and the axes 75 at both ends of each bar are parallel.

The diameter of the bar member 50 may be selected such that the end thereof will be telescopically received within the corresponding tubular leg 54, 58 such that the bolt holes 72, 74 are aligned in bolt receiving registry. Alternately, the top bar 50 may have a diameter substantially equivalent to the diameter of the legs 58 and may be provided with a reduced diameter end portion. As a further alternative, the top bar 50 may have a diameter such that the tubular end portion 68, 70 of a leg is telescopically received therein.

The spacing bracket assembly 66 is illustrated in greater detail in FIG. 2. It is understood that the bracket 64 is substantially identical to the bracket 66 and therefore a description of the spacing bracket assembly 66 will suffice to describe both of the bracket assemblies 64, 66.

With the bar member 50 telescopically joined to the end portion of the leg 54 such that the associated bolt holes 72, 74 are in bolt receiving registry, one end of the spacing bracket assembly 66 is positioned over the leg 54 and secured by a bolt 78. The bolt 78 passes through the spacing bracket assembly 66, the leg 54, and the bar member 50 to both attach the spacing bracket 66 to the frame 46 and to rigidly connect the bar member 50 to the leg 54. The second bar member 50 is suitably connected to another leg 58 by the bolt 80 passing through the properly oriented bolt holes 72, 74 of the respective members and a second end of the spacing bracket assembly 66.

Turning now to the spacing bracket assembly 66, it will be observed that the spacing bracket assembly may include a generally rectangular strap-like body portion 82 which is provided with two semi-cylindrically configured ends 84, 86. The semi-cylindrical configuration of each end 84, 86 conforms to the external curvature of the corresponding leg portion 54, 58 or bar member 50 depending on the manner of telescopic connection. In this manner, the cylindrically configured end portion 84 in cooperation with the conforming underlying surface of the leg 54, 58 is effective to prevent lateral movement of the bar members 50 in the plane perpendicular to the axes 69, 71 of the connecting bolts 78, 80. The connecting bolts 78, 80 may be provided with suitable conventional lock washers 88, and nuts 90 to securely connect the three members: the bar member 50, the leg 54 and the spacing bracket assembly 66.

A conventional cup-shaped plastic bolt cover 92 may also be provided for each bolt 78, 80 to cover projecting end thereof and prevent injurious contact with children or adults near the swing.

The body portion 82 of the spacing bracket assembly 66 may be provided with an opening 94 intermediate the ends thereof. Preferably the opening 94 is centrally positioned so that force loads thereon may be shared by both ends thereof. The opening 94 is adapted to receive an eye bolt 96 which carries the swing bearing assembly 44. The bolt 96 cooperates with a nut 98 below the bracket assembly 66 and a second nut 100 above the bracket assembly 66 to vertically position the eye bolt 96. A suitable plastic bolt cover 102 may be provided to protect the end threads of the eye bolt 96.

Figure 3:
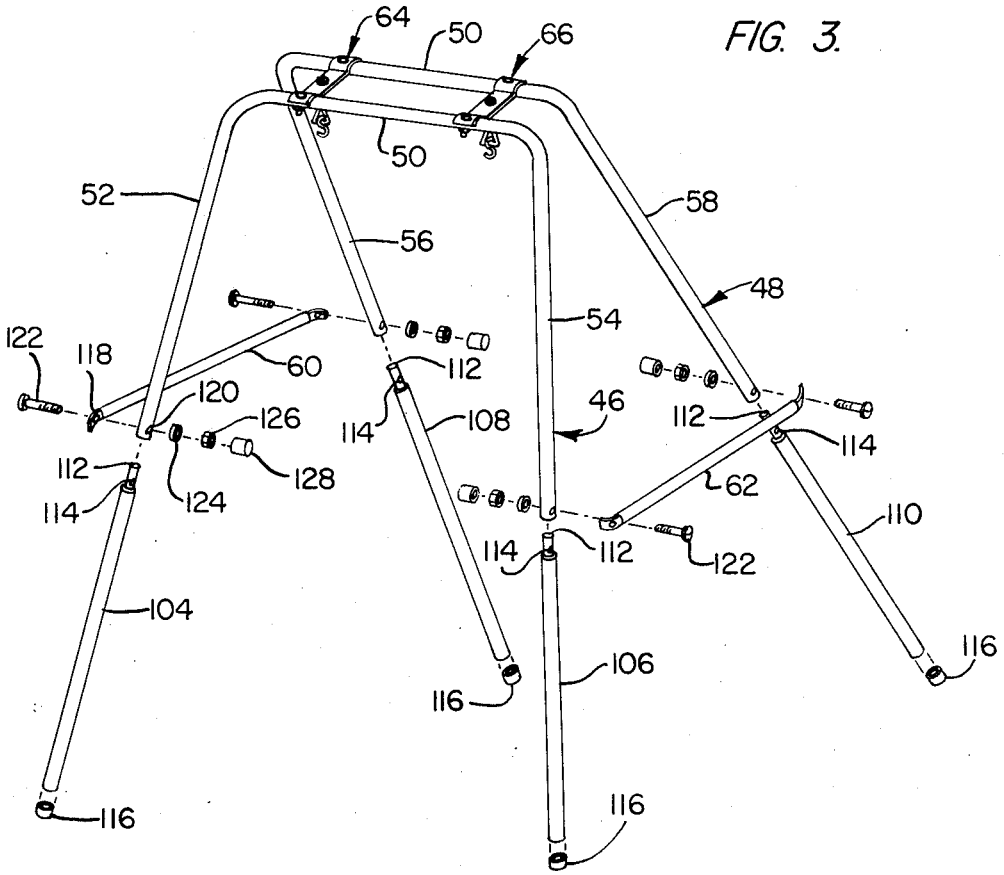
FIG. 3 is a perspective view illustrating the method of assembling the remaining portions of the swing support frame assembly.

Turning now to FIG. 3, each U-shaped frame 46, 48 includes a pair of upper leg members 52, 54 and 56, 58 respectively. In addition, each U-shaped frame 46, 48 includes a pair of lower leg members 104, 106 and 108, 110 respectively. Each lower leg member 104, 106, 108 110 is telescopically connected to the corresponding upper leg member and may include an upwardly extending reduced diameter section 112 and a bolt receiving opening 114. The lower end portion of each lower leg section may be provided with a suitable end closure cap 116 to prevent damage to a supporting surface and to protect users of the swing apparatus from sharp edges which might otherwise be present at the end of the tube.

Each end of each longitudinal horizontal brace 60, 62 may be flattened and given a curvature conforming to the external curvature of the underlying leg portion. Moreover, each flattened end section 118 includes a bolt receiving opening adapted for alignment with the bolt receiving openings 120 in the lower end of the upper leg portion 52. To connect the upper and lower leg sections 52, 104 a bolt 122 passes through the opening of the flattened end 118 of the brace member 60, 62 and through the aligned bolt receiving openings 114, 120 of the corresponding leg sections. A suitable lock washer 124, a nut 126, and a suitable plastic bolt cover 128 may be provided to complete the attachment and to protect users of the swing apparatus from sharp edges of the bolt 122, Thus, the lower leg section is telescopically connected to the lower end portion of the upper leg section and is connected to the corresponding brace member 60 by a single bolt 122.

The upper leg portions 52, 54, 56, 58 and the lower leg portions 104, 106, 108, and 110 have a substantially equal longitudinal length as may be seen from FIG. 3. Accordingly, convenient packaging of the swing support assembly for transportation is effected.

Figure 4:
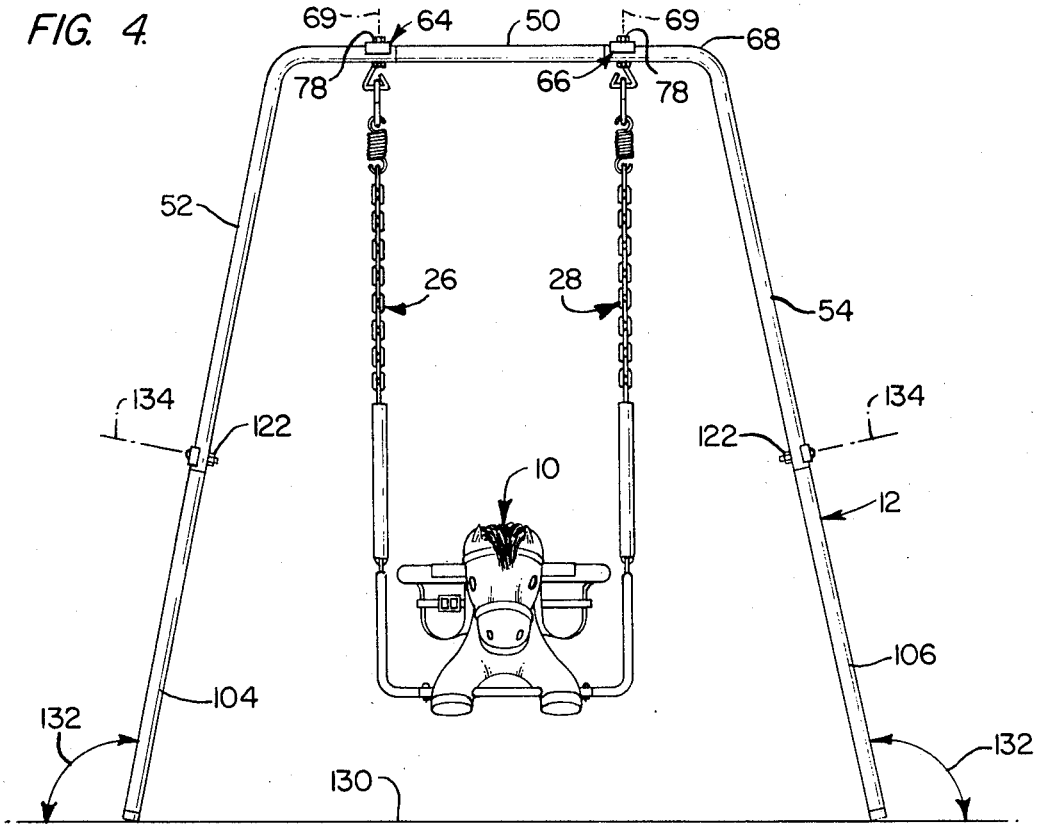
FIG. 4 is a front elevational view of the swing and support assembly taken longitudinally thereof.

Turning now to FIG. 4, the curved portion of leg 54 is configured such that the short tubular end portion 68 is generally horizontal and substantially parallel to a supporting surface 130. Moreover, the angle between the short tubular end portion 68 and the long tubular portion of leg 54 in the plane defined by the curved portion is selected so that the lower portion 106 of the leg 54 contacts the supporting surface 130 with an obtuse angle 132 externally of the swing support structure 12. This obtuse angle 132 occurs at the intersection of each leg 52, 54, 56, 58 with the supporting surface and enhances the lateral stability of the swing support frame. More specifically, any tendency of the support bar 50 to move laterally must not only deform the curved portion of each associated leg 52, 54 but also must exert a force to raise one leg to a vertical posture. During a potential collapse mode of failure of a structure, a force tending to raise a portion thereof is a stabilizing factor.

Each fastener 122 connecting upper and lower leg portions with one end of a longitudinal brace includes a bolt hole axis 134. Preferably, the axis 134 is inclined with respect to the supporting surface 130 while lying substantially in the plane of the curved leg portion. In this manner, the axis 134 is substantially normal to the connected members and does not induce any undesired stresses therein.

Figure 5:
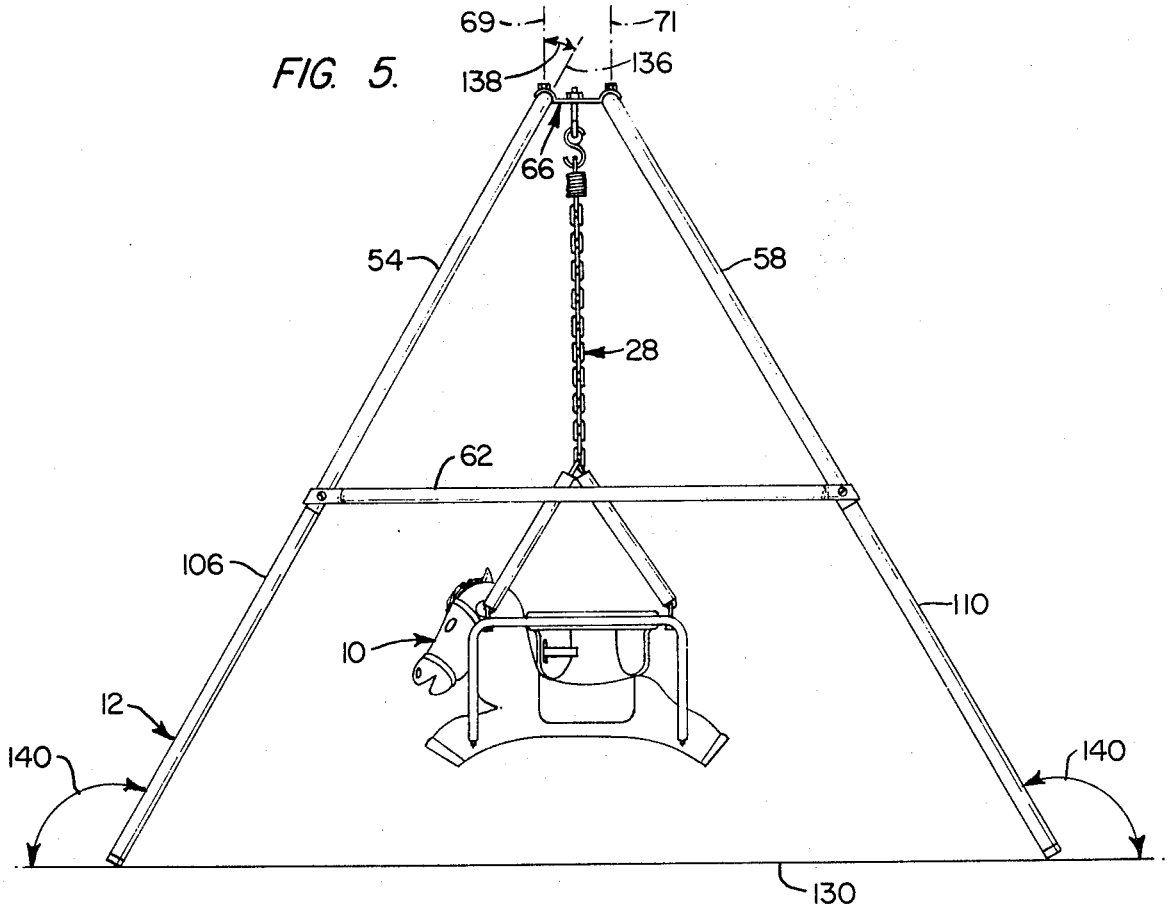
FIG. 5 is a side elevational view of the swing and support assembly taken laterally thereof.

The axes 69 of the bolts 78 fastening the spacing brackets 64, 66 to the bar member 50 and the corresponding leg 52, 54 are generally vertical and are inclined relative to the lower leg portion by an angle equivalent to the complement of the supplement of angle 132. Moreover, the axes 69 are inclined with respect to the plane 136 of the curved leg portion (see FIG. 5) by an angle 138 which defines an obtuse longitudinal external angle 140 between the leg 54 and the supporting surface 130. Each leg 52, 54, 56, 58 is similarly constructed to that each leg makes the corresponding angle with the supporting surface. It can be seen from FIG. 5 that the angle 140 is the supplement of the complement of angle 138. The obtuse angle 140 enhances longitudinal stability of the swing support frame assembly 12 in the manner outlined above in connection with the lateral angles 132.

It will now be apparent to those skilled in the art that there has been provided in accordance with the present invention a novel swing support frame assembly which substantially satisfies the objects and advantages as set forth above. In addition, it will be apparent that many modifications, variations, equivalents and substitutions may be made for the elements of the present invention as defined in the appended claims. Accordingly, all such modifications, variations, equivalents and substitutions that fall within the scope of the invention as defined by the appended claims are expressly intended to be embraced thereby.

What is claimed is:

1. A support assembly for swinging apparatus including:

a pair of tubular front leg means and a pair of tubular rear leg means;

each of said leg means comprising an upper and a lower member;

each upper member of said front leg means comprising a curved tubular bar operable to define a front leg plane and to define an obtuse lateral angle between said front leg means and a supporting surface;

each upper member of said rear leg means comprising a curved tubular bar operable to define a rear leg plane and to define an obtuse angle between said rear leg means and a supporting surface;

each of said curved tubular bars having a short tubular top section with a top bolt receiving opening therethrough and a longer bottom section with a bottom bolt receiving opening therethrough;

the axes of said top bolt receiving openings of said curved tubular bars of the front leg means being inclined with respect to said front leg plane to define an obtuse longitudinal angle between said front leg means and a supporting surface;

the axes of said top bolt openings of said curved tubular bars of said rear leg means being inclined with respect to said rear leg plane to define an obtuse longitudinal angle between said rear leg means and said supporting surface;

each lower member of said front and rear leg means comprising a tubular member operable to be telescopingly connected to a respective one of said longer bottom sections of said curved tubular bars and having a bolt receiving opening alignable with the bottom bolt receiving opening of the respective longer bottom section of the curved tubular bars;

a pair of brace means for longitudinally spacing the front frame and the rear frame;

each brace means having a pair of ends, each end having a bolt receiving opening;

one end of each brace means being operable to be connected with said front leg means at a location where the bolt receiving opening at that end of said brace means is aligned with the bolt receiving openings of the telescoped portions of said front leg means, and the other end of each brace means being operable to be connected with said rear leg means at a location where the bolt receiving opening at that end of said brace means is aligned with the bolt receiving openings of the telescoped portions of said rear leg means;

a pair of tubular support bars having parallel bolt receiving openings in each end;

the ends of one support bar being operable to be telescopingly connected to said short tubular top sections of the curved tubular bars of the front leg means, with said top bolt receiving openings thereof aligned with the bolt receiving openings of said ends of said one tubular support bar, to define an inclined and generally U-shaped front frame;

the ends of the other support bar being operable to be telescopingly connected to said short tubular top sections of the curved tubular bars of the rear leg means, with said top bolt receiving openings thereof alined with the bolt receiving openings of said ends of said other tubular support bar, to define a generally U-shaped rear frame inclined oppositely to said generally U-shaped front frame;

a pair of support brackets operable to interconnect and space the front frame from the rear frame in mutually inclined orientation, and operable to inhibit lateral movement between the front frame and the rear frame;

each support bracket including a generally rectangular flat portion having a swing supporting opening intermediate the ends thereof, and a pair of arcuate end portions each having a bolt receiving opening;

one end portion of each bracket operable to be connected to the front frame with its bolt receiving opening aligned with the bolt receiving openings of the telescoped tubular support bar and short tubular top sections of the front frame;

the other end portion of each bracket being operable to be connected to the rear frame with its bolt receiving opening aligned with the bolt receiving openings of the telescoped tubular support bar and short tubular top sections of the rear frame.

* * * * *